US011821167B2

(12) United States Patent
Kean

(10) Patent No.: US 11,821,167 B2
(45) Date of Patent: Nov. 21, 2023

(54) EXCAVATOR WITH IMPROVED MOVEMENT SENSING

(71) Applicant: Deere & Company, Moline, IL (US)

(72) Inventor: Michael G Kean, Maquoketa, IA (US)

(73) Assignee: DEERE & COMPANY, Moline, IL (US)

( * ) Notice: Subject to any disclaimer, the term of this patent is extended or adjusted under 35 U.S.C. 154(b) by 697 days.

(21) Appl. No.: 16/830,730

(22) Filed: Mar. 26, 2020

(65) Prior Publication Data

US 2021/0071390 A1 Mar. 11, 2021

Related U.S. Application Data

(63) Continuation-in-part of application No. 16/561,556, filed on Sep. 5, 2019.

(51) Int. Cl.
*E02F 9/20* (2006.01)
*E02F 9/26* (2006.01)

(52) U.S. Cl.
CPC ..... *E02F 9/2029* (2013.01); *E02F 9/2033* (2013.01); *E02F 9/2083* (2013.01); *E02F 9/262* (2013.01)

(58) Field of Classification Search
CPC ..... E02F 9/2029; E02F 9/2033; E02F 9/2083; E02F 9/262; E02F 3/435
See application file for complete search history.

(56) References Cited

U.S. PATENT DOCUMENTS 6,735,888 B2 5/2004 Green et al.
7,516,563 B2 4/2009 Koch
9,598,036 B2 3/2017 Lim et al.
9,745,721 B2 8/2017 Linstroth et al.
10,829,911 B2 11/2020 Kennedy et al.
2004/0140923 A1 7/2004 Tucker et al.
2004/0210370 A1 10/2004 Gudat et al.
2009/0043462 A1 2/2009 Stratton et al.
2009/0293322 A1 12/2009 Faivre et al.
(Continued)

FOREIGN PATENT DOCUMENTS

CN 108549771 A * 9/2018
CN 108549771 A 9/2018
(Continued)

OTHER PUBLICATIONS

Application and Drawings for U.S. Appl. No. 16/561,556, filed Sep. 5, 2019, 25 pages.
(Continued)

*Primary Examiner* — Ig T An
(74) *Attorney, Agent, or Firm* — Christopher R. Christenson; Kelly, Holt & Christenson, PLLC

(57) ABSTRACT

An excavator includes a rotatable house and a bucket operably coupled to the rotatable house. The excavator also includes one or more swing sensors configured to provide at least one rotation sensor signal indicative of rotation of the rotatable house and one or more controllers coupled to the sensor. The one or more controllers being configured to implement inertia determination logic that determines the inertia of a portion of the excavator and control signal generator logic that generates a control signal to control the excavator, based on the inertia of the portion of the excavator.

13 Claims, 11 Drawing Sheets

(56) References Cited

U.S. PATENT DOCUMENTS

| | | | | |
|---|---|---|---|---|
| 2012/0237083 | A1 | 9/2012 | Lange et al. | |
| 2012/0327261 | A1 | 12/2012 | Bilandi et al. | |
| 2013/0054097 | A1 | 2/2013 | Montgomery | |
| 2013/0103271 | A1 | 4/2013 | Best et al. | |
| 2014/0107895 | A1* | 4/2014 | Faivre | E02F 9/2029 701/50 |
| 2014/0188333 | A1 | 7/2014 | Friend | |
| 2014/0208728 | A1* | 7/2014 | Ma | E02F 9/123 91/363 R |
| 2014/0257647 | A1 | 9/2014 | Wu et al. | |
| 2014/0354813 | A1 | 12/2014 | Ishimoto | |
| 2015/0249821 | A1 | 9/2015 | Tanizumi et al. | |
| 2016/0138248 | A1 | 5/2016 | Conway et al. | |
| 2016/0176338 | A1 | 6/2016 | Husted et al. | |
| 2016/0244949 | A1 | 8/2016 | Kanemitsu | |
| 2016/0305784 | A1 | 10/2016 | Roumeliotis et al. | |
| 2016/0377437 | A1 | 12/2016 | Brannstrom et al. | |
| 2017/0220044 | A1 | 8/2017 | Sakai et al. | |
| 2018/0137446 | A1 | 5/2018 | Shike et al. | |
| 2018/0277067 | A1 | 9/2018 | Tentinger et al. | |
| 2018/0373966 | A1 | 12/2018 | Beschorner et al. | |
| 2019/0194913 | A1 | 6/2019 | Petrany et al. | |
| 2019/0218032 | A1 | 7/2019 | Whitfield, Jr. et al. | |
| 2019/0302794 | A1 | 10/2019 | Kean et al. | |
| 2020/0071912 | A1 | 3/2020 | Kennedy et al. | |
| 2020/0269695 | A1 | 8/2020 | Pfaff et al. | |
| 2020/0310442 | A1 | 10/2020 | Halder et al. | |
| 2020/0325650 | A1 | 10/2020 | Tsukamoto et al. | |
| 2020/0347580 | A1 | 11/2020 | Raszga et al. | |
| 2020/0353916 | A1 | 11/2020 | Schwartz et al. | |
| 2021/0002850 | A1* | 1/2021 | Wu | E02F 3/435 |
| 2021/0230841 | A1 | 7/2021 | Kurosawa | |

FOREIGN PATENT DOCUMENTS

| | | | | |
|---|---|---|---|---|
| DE | 102017215379 | A1 | 3/2019 | |
| DE | 102017222966 | A1 | 6/2019 | |
| DE | 102018209336 | A1 | 12/2019 | |
| EP | 2631374 | A1 | 8/2013 | |
| EP | 3399109 | A1 | 11/2018 | |
| JP | H0971965 | A | 3/1997 | |
| JP | 2008101416 | A | 5/2008 | |
| JP | 2015195457 | A | 3/2018 | |
| JP | 6389087 | B2 | 9/2018 | |
| JP | 2019194074 | A | 11/2019 | |
| WO | WO-2009086601 | A1 * | 7/2009 | E02F 3/304 |
| WO | WO2015121818 | A2 | 8/2015 | |

OTHER PUBLICATIONS

Application and Drawings for U.S. Appl. No. 16/803,603, filed Feb. 27, 2020, 34 pages.
Final Office Action for U.S. Appl. No. 16/561,556 dated Jun. 22, 2022, 16 pages.
Final Office Action for U.S. Appl. No. 16/803,603, dated Jun. 10, 2022, 14 pages.
Non-Final Office Action for U.S. Appl. No. 16/803,603 dated Dec. 21, 2021, 12 pages.
Non-Final Office Action for U.S. Appl. No. 16/803,603 dated Dec. 1, 2022, 15 pages.
Non-Final Office Action for U.S. Appl. No. 16/122,121 dated Jun. 23, 2020, 18 pages.
Non-Final Office Action for U.S. Appl. No. 16/561,556, dated Jan. 18, 2022, 16 pages.
Prosecution History for U.S. Appl. No. 16/122,121 including: Response to Restriction Requirement dated Feb. 10, 2020, Restriction Requirement dated Dec. 20, 2019, and Application and Drawings filed Sep. 5, 2018, 66 pages.
U.S. Appl. No. 16/122,121 Notice of Allowance dated Sep. 9, 2020, 8 pages.
Non-Final Office Action for U.S. Appl. No. 16/561,556 dated Oct. 7, 2022, 16 pages.
Final Office Action for U.S. Appl. No. 16/561,556 dated Feb. 1, 2023, 18 pages.
Notice of Allowance for U.S. Appl. No. 16/803,603, dated Mar. 30, 2023, 10 pages.
U.S. Appl. No. 16/561,556 Non Final Office Action dated Jun. 21, 2023, 17 pages.

* cited by examiner

EXCAVATOR WITH IMPROVED MOVEMENT SENSING

CROSS-REFERENCE TO RELATED APPLICATION

The present application is a continuation-in-part of and claims priority of U.S. patent application Ser. No. 16/561,556, filed Sep. 5, 2019, the content of which is hereby incorporated by reference in its entirety.

FIELD OF THE DESCRIPTION

The present description is related to excavators used in heavy construction. More particularly, the present description is related to improved motion sensing and control in such excavators.

BACKGROUND

Hydraulic excavators are heavy construction equipment generally weighing between 3500 and 200,000 pounds. These excavators have a boom, a stick, a bucket, and a cab on a rotating platform that is sometimes called a house. A set of tracks is located under the house and provides movement for the hydraulic excavator.

Hydraulic excavators are used for a wide array of operations ranging from digging holes or trenches, demolition, placing or lifting large objects, and landscaping. Such excavators are also often used along a roadway during road construction. As can be appreciated, the proximity of such heavy equipment to passing motorists and/or other environmental objects, requires very safe operation. One way in which excavator operational safety is ensured is with the utilization of electronic fences or e-fences. An e-fence is an electronic boundary that is set by an operator such that the excavator bucket/arm will not move beyond a particular limit position. Such limits may be angular (left and right stops) and/or vertical (upper and/or lower bounds).

Precise excavator operation is very important in order to provide efficient operation and safety. Providing a system and method that increases excavator operational precision without significantly adding to cost would benefit the art of hydraulic excavators.

The discussion above is merely provided for general background information and is not intended to be used as an aid in determining the scope of the claimed subject matter.

SUMMARY

An excavator includes a rotatable house and a bucket operably coupled to the rotatable house. The excavator also includes one or more swing sensors configured to provide at least one rotation sensor signal indicative of rotation of the rotatable house and one or more controllers coupled to the sensor. The one or more controllers being configured to implement inertia determination logic that determines the inertia of a portion of the excavator and control signal generator logic that generates a control signal to control the excavator, based on the inertia of the portion of the excavator.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
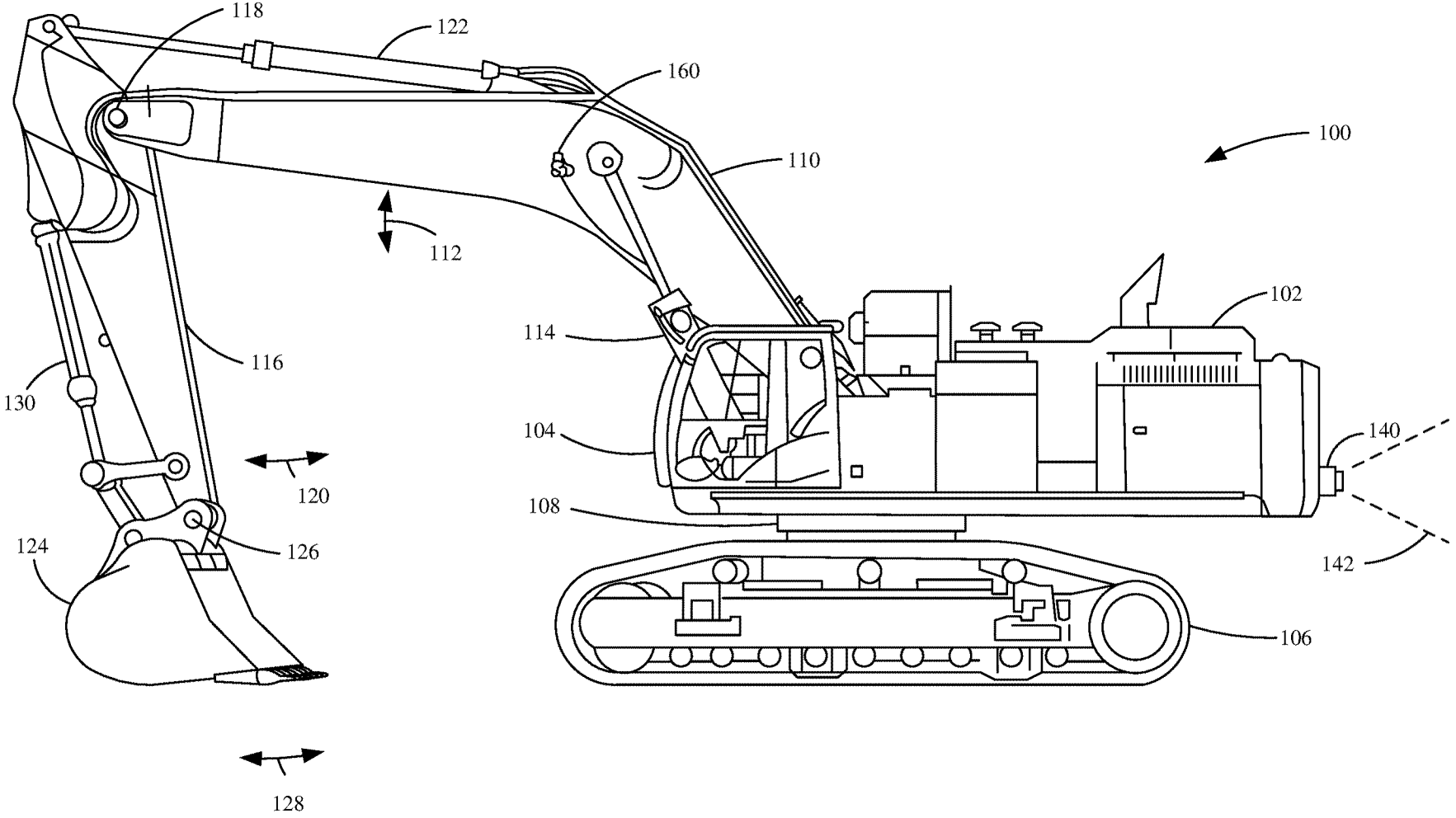
FIG. 1 is a diagrammatic view showing an example excavator.

FIG. 1 is a diagrammatic view showing an example excavator. Hydraulic excavator or machine 100 includes a house 102 having an operator cab 104 rotatably disposed above tracked portion 106. House 102 may rotate 360 degrees about tracked portion 106 via rotatable coupling 108. A boom 110 extends from house 102 and can be raised or lowered in the direction indicated by arrow 112 based upon actuation of hydraulic cylinder 114. A stick 116 is pivotably connected to boom 110 via joint 118 and is movable in the direction of arrows 120 based upon actuation of hydraulic cylinder 122. Bucket 124 is pivotably coupled to stick 116 at joint 126 and is rotatable in the direction of arrows 128 about joint 126 based on actuation of hydraulic cylinder 130.

When an operator within cab 104 needs to back machine 100 up, he or she engages suitable controls and automatically activates backup camera 140 which provides a backup camera image corresponding to field of view 142 on a display within cab 104. In this way, much like in automobiles, the operator can carefully and safely back the excavator up while viewing the backup camera video output.

Figure 2:
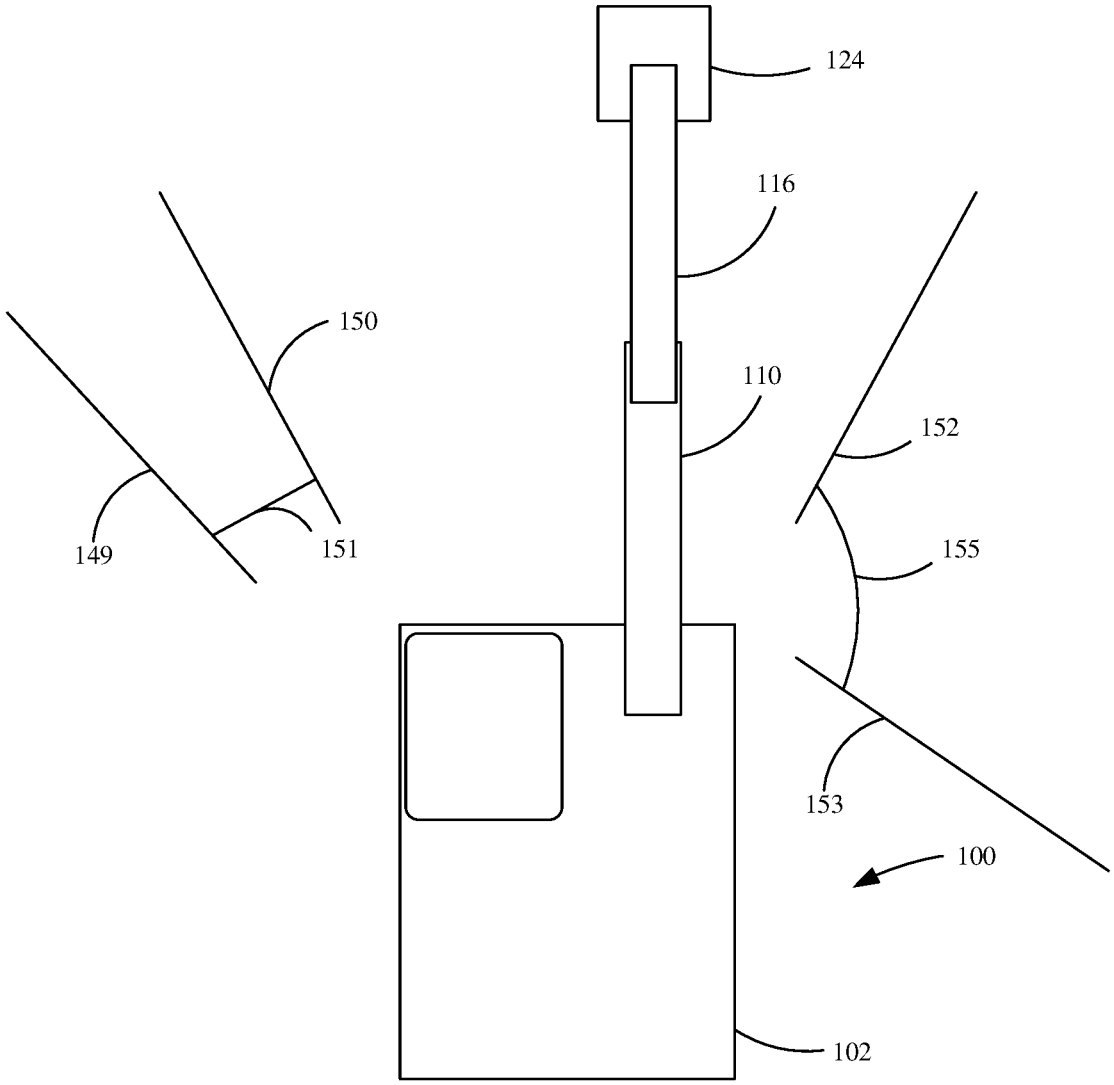
FIG. 2 is a diagrammatic top view showing an example excavator illustrating an e-fence.

FIG. 2 is a top view of machine 100 illustrating the operation of limit positions 150, 152. A limit position or e-fence is an electronic position limit generated by an operator to ensure that machine 100 does not move past that position during operation. Limit positions are vitally important in operational scenarios where machine 100 may be operating in close proximity to structures or passing motorists. In order to set a limit positon, the operator will typically extend the stick to its maximum reach, and then rotate the house to a first angular limit, such as limit position 150. Once suitably positioned, the control system of the machine is given an input indicative of the setting of a particular e-fence (in this case left rotational stop) and this limit position is stored by the controller of the excavator as e-fence information. Similarly, house 102 is then rotated to the opposite rotational stop (indicated at reference numeral 152) and an additional limit input is provided. In this way, machine 100 is provided with information such that during operation it will automatically inhibit any operator attempts or control inputs that attempt to move beyond the previously-set e-fence limits. In some examples, machine 100 can move beyond limit positions 150, 152. For instance, machine 100 moves beyond limit 152 and is throttled. As shown, area 151 is a throttling zone defined by limits 149 and 150. In this area, machine 100 may swing but is limited to a given speed. When machine 100 exits area 151 then normal speeds are controls are resumed. This throttling may be especially useful for example, if a foundation wall were proximate limit 149 and a user needs to dig as close as possible to the wall. Similarly, area 155 may be another throttling area defined by limits 152 and 153. Area 155 can have the same throttling as area 151 or can have a different maximum speed.

During operation, machine 100 generally obtains positional information relative to boom 110 using an inertial measurement unit (IMU) 160 (shown in FIG. 1) mounted to boom 110. The IMU is an electronic device that measures and reports a body-specific force, angular rate, and sometimes orientation using a combination of accelerometers, gyroscopes, magnetometers, etc. In order to obtain positional information, the accelerometer or gyroscopic output of IMU 160 is integrated over time. While this approach is quite effective for virtually all operational modes of machine 100, it has limitations when the signal of the accelerometer and/or gyroscope is relatively small such as during slow or low acceleration movements.

In these situations, the presence of a backup camera, such as backup camera 140 (shown in FIG. 1), on a hydraulic excavator with machine vision or suitable computer vision algorithms, can provide a signal that augments that of the traditional IMU. Accordingly, in contrast with prior techniques where the backup camera is only used when the operator is preparing to back the excavator, backup camera 140 is continuously used and its video stream/output is processed to provide supplemental movement information in order to provide greater movement sensing and precision for machine 100. Examples of the manner in which this improved excavator motion sensing is used is provided in at least two embodiments described below.

Figure 3:
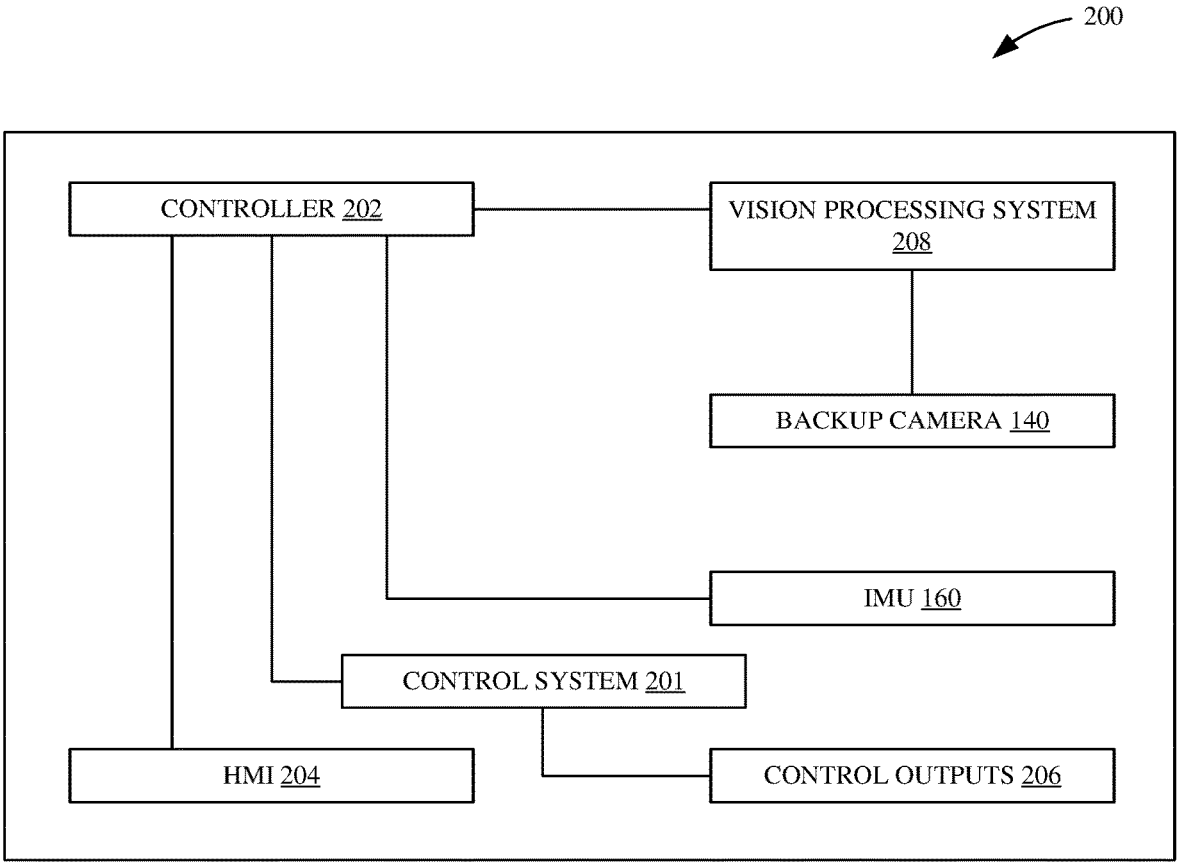
FIG. 3 is a block diagram showing an example excavator control system.

FIG. 3 is a diagrammatic view showing an example control system 200 of an excavator (e.g., machine 100). Control system 200 includes controller 202 that is configured to receive one or more inputs, perform a sequence of programmatic steps to generate one or more suitable machine outputs for controlling the operation of a hydraulic excavator. Controller 202 may include one or more microprocessors, or even one or more suitable general computing environments as described below in greater detail. Controller 202 is coupled to human machine interface module 204 in order to receive machine control inputs from an operator within cab 104. Examples of operator inputs include joystick movements, pedal movements, machine control settings, touch screen inputs, etc. Additionally, HMI module 204 also includes one or more operator displays in order to provide information regarding excavator operation to the operator. At least one of the operator displays of HMI module 204 includes a video screen that, among other things, may display an image from backup camera 140. Additionally, when an e-fence limit is within the field of view 142 of backup camera 140, the display may also provide an indication of such. Essentially, any suitable input from an operator or output to an operator between machine 100 and the operator disposed within cab 104 may form part of HMI module 204. Control system 200 also includes a plurality of control outputs 206 coupled to controller 202. Control outputs 206 represent various outputs provided to the actuators, such as hydraulic valve controllers to engage the various hydraulics and other suitable systems of machine 100 for excavator operation. As shown, control system 200 includes IMU 160 operably coupled to controller 202 such that controller 202 is provided with an indication of the position of boom 110, and to some extent stick 116 and bucket 124.

As shown, backup camera 140 of control system 200 is operably coupled to vision processing system 208 which is coupled to controller 202. While vision processing system 208 is illustrated as a separate module from controller 202, it is expressly contemplated that vision processing system 208 may be embodied as a software module executing within controller 202. However, for ease of explanation, vision processing system 208 will be described as separate vision processing logic receiving a video signal from backup camera 140 and providing positional information to controller 202. Vision processing system 208 is adapted, through hardware, software, or a combination thereof, to employ visual odometry to calculate motion of the machine based on analysis of a succession of images obtained by backup camera 140. As defined herein, visual odometry, is the process of determining the position and orientation of a controlled mechanical system by analyzing associated camera images. Using visual odometry techniques, vision processing system 208 provides an estimate of machine motion to controller 202. Controller 202 then combines the estimate of machine motion received from vision processing system 208 and IMU 160 and generates composite position information of the hydraulic excavator that is more precise than using the signal of IMU 160 alone. This is because the signals from vision processing system 208 and IMU 160 complement each other in a particularly synergistic way. During relatively high speed or high acceleration movements, IMU 160 provides accurate signals relative to the machine's movement while backup camera 140 generally provides a series of blurred images. In contrast, when machine 100 generates relatively slow or low-acceleration movements, the signal from IMU 160 is not as reliable or accurate. However, using visual odometry techniques, vision processing system 208 is able to provide very precise motion information. These two measurements for the change in swing angle are fused using controller 202 and a suitable calculation, such as a calculation that weighs a particular input modality based upon the speed or magnitude of the movement. For example, during relatively high-speed or acceleration movements, controller 202 may use the signal from IMU 160 to a significant extent, such as weighted 80% vs. 20% to visual odometry. In contrast, when the motion is slow and/or the acceleration is very low, the signals of IMU 160 may be significantly de-weighted (such as 10% vs. a 90% weight using the information from vision processing system 208). In this way, controller 202 is generally provided with enhanced positional information in virtually all contexts.

While backup camera 140 is intended to encompass any legacy or standard backup camera, it is expressly contemplated that as embodiments of the present invention are used in more and more situations, and as camera technology improves, backup camera 140 may be a relative high-speed video camera that is less susceptible to motion blur, and/or may have features that are not currently provided in commercially-available backup cameras. As used herein, backup camera 140 is intended to include any vision system that is mounted relative to an excavator and includes a field of view that is substantially opposite that from an operator sitting within cab 104. Backup camera 140 may include any suitable image acquisition system including an area array device such as a charge couple device (CCD) or a complementary metal oxide semi-conductor (CMOS) image device. Further, backup camera 140 may be coupled to any suitable optical system to increase or decrease the field of view 142 under control of controller 202. Further still, backup camera may be provided with additional illumination, such as a backup light, or dedicated illuminator, such that images can easily be acquired when excavator is operated in low-light conditions. Further still, while a single backup camera 140 is illustrated, it is expressly contemplated that an additional, or second, backup camera may also be used in conjunction with backup camera 140 to provide stereo vision. In this way, using stereo vision techniques, three-dimensional imagery and visual odometry can be employed in accordance with embodiments of the present invention.

Figure 4:
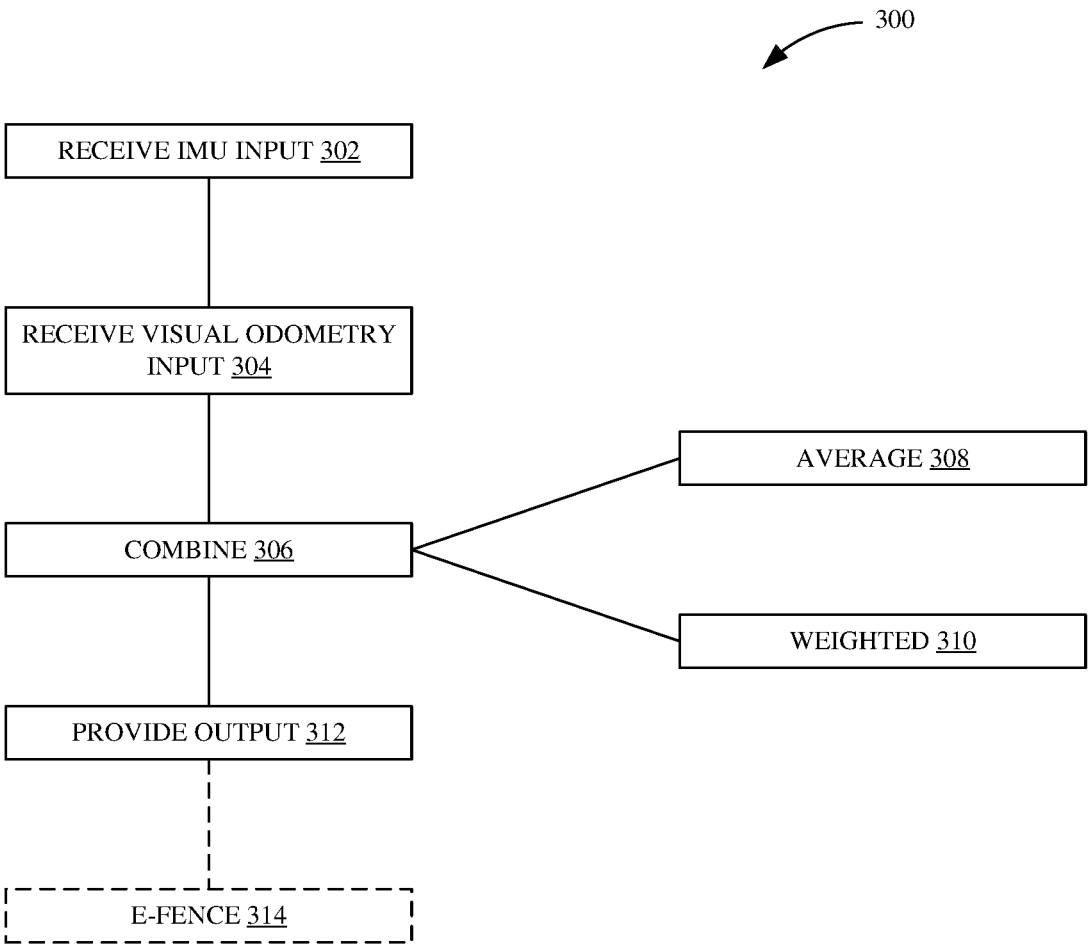
FIG. 4 is a flow diagram showing an example method of processing sensor inputs in a hydraulic excavator

FIG. 4 is a flow diagram showing an example method of providing improved position sensing in an excavator. Method 300 begins at block 302 where a controller, such as controller 202, receives IMU input. At block 304, visual odometry information is received, such as from vision processing system 208. While method 300 is shown having block 304 occurring after block 302, it is expressly contemplated that the order of such information acquisition in blocks 302 and 304 can be interchanged. Regardless, by block 306, a controller, such as controller 202 has a combination of IMU information received via block 302, and visual odometry information received via block 304. At block 306, this information is combined to provide position information that has better precision than either signal alone. This combination can be done simply by averaging the positional signals, as indicted at block 308, or, by performing a weighted average based upon the magnitude of the acceleration and/or movement, as indicated at block 310. Next, at block 312, the combined positional information is provided as an output by the controller. This output may be provided as an indication to an operator via HMI module 204 (shown in FIG. 3). Further, the output may optionally be provided to e-fence processing block 314 to determine if the combined positional output is at or within a set e-fence. In this way, even if the boom of the hydraulic excavator is rotated very slowly, and the accuracy of the IMU information is reduced, the combined positional information provided via block 312 will still be of relatively high quality because it will use the visual odometry processing from block 304. Accordingly, even during very slow machine movements, e-fences will be carefully and precisely enforced. The combinational output helps compensate for motion blur in the backup camera image during high speed swings and still stabilizes the swing angle at low speeds where the system would otherwise experience drift due to integration of the gyro-noise from the IMU information, from block 302.

Figure 5:
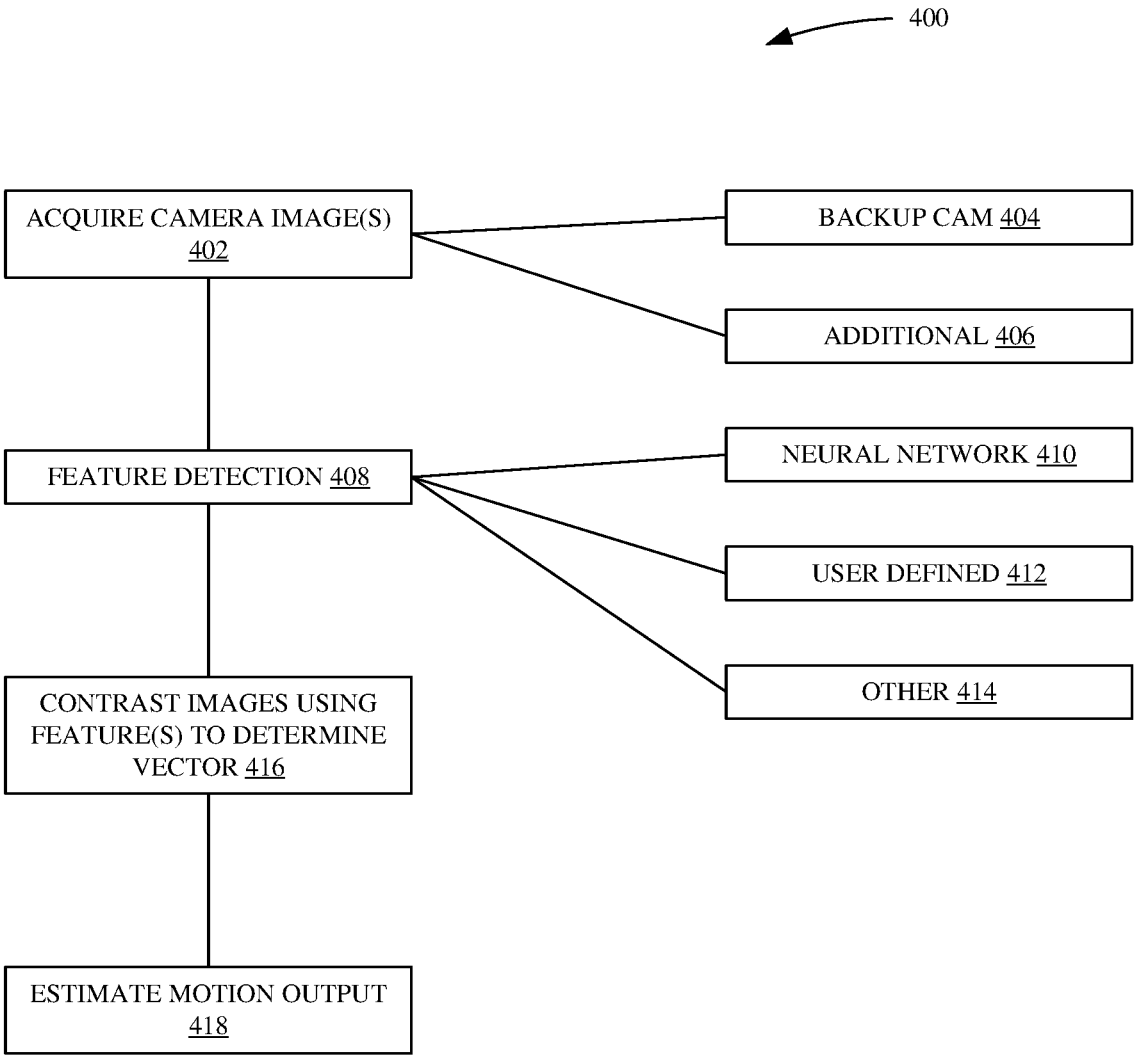
FIG. 5 is a flow diagram showing an example method of providing movement information based upon one or more acquired images.

FIG. 5 is a flow diagram showing an example method of providing visual odometry for an excavator. Method 400 begins at block 402 where one or more images are acquired. These images may be acquired from a backup camera, as indicated at block 404, as well as from one or more additional cameras as indicated at block 406. Once images are acquired, block 400 continues at block 408 where feature detection is performed. Feature detection is an important aspect of visual odometry in that it identifies one or more features in the images that can be used for motion detection. Accordingly, it is important that a feature not be of an object or aspect of the image that is relatively transitory or moves on its own, such as a passing worker, or an animal. Instead, feature detection from block 408 is performed to identify one or more features in the image that are representative of the stationary environment around the vehicle such that motion of such a detected feature is indicative of motion of the vehicle itself.

Feature detection 408 can be done using a suitable neural network detection, as indicated at block 410. Further, feature detection 408 may be explicitly performed as a user-defined operation where a user simply identifies items in an image that the user or operator knows to be stationary, as indicated at block 412. Additionally, feature detection can be also performed using other suitable algorithms, as indicated at block 414. As an example of a known feature detection technique in visual odometry, an optical flow field can be constructed, using the known Lucas-Kanade method. Further, while various different techniques are described for providing feature detection, it is also expressly contemplated that combinations thereof may be employed as well. Next, at block 416, successive images are contrasted using the features detected at block 408 to estimate a movement vector indicative of movement of the machine that generated the detected difference in features in the successive images. At block 418, this estimated motion vector is provided as a visual odometry output.

When an excavator is tracked, the vision system, in accordance with embodiments described herein, uses visual odometry to calculate motion of the excavator and recalculate swing angles associated with a previously-defined e-fence since these swing angles change when the machine moves. In this way, the operator need not reset the e-fence as the excavator is moved. In addition to this dynamic tracking, the camera images can also be processed during operation in order to identify new visual markers or features in the environment associated with the extremes of acceptable swing motion at the new position. Accordingly, features or visual markers could be leap-frogged from one machine position to another and used to maintain the position of the e-fence relative to the excavator without the need for a GPS system.

Figure 6:
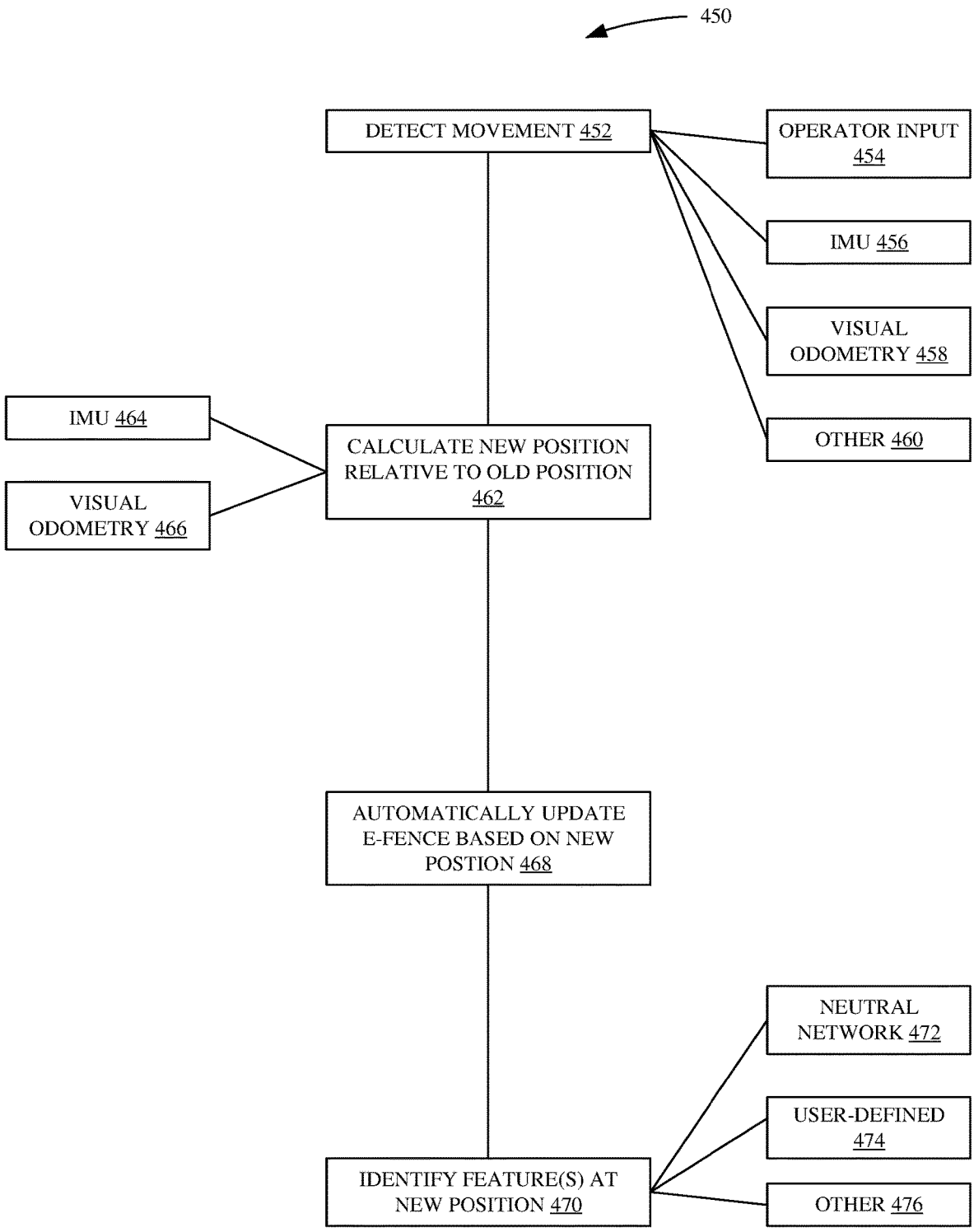
FIG. 6 is a flow diagram showing an example method of automatically updating e-fence information

FIG. 6 is a flow diagram of a method of automatically updating e-fence information and detecting new features upon movement of an excavator in accordance with embodiment of the present invention. Method 450 begins at block 452 where excavator movement is detected. Such movement detection can be sensed via operator input, as indicated at block 454, via IMU signals, as indicated at block 456, via visual odometry, as indicated at block 458, or via other techniques, as indicated at block 460. Once movement is detected, control passes to block 462 where a new position of the excavator is calculated relative to the old position. For example, the new position may indicate that the excavator has moved forward 12 feet and that the tracked portion has rotated 12°. As can be appreciated, when this occurs, previous e-fence information will no longer be valid. Accordingly, it is important for the e-fence to be updated to ensure the safety of the operator and those in proximity to the excavator.

Previously, upon such movement, the operator would need to manually reset the e-fence by moving to acceptable swing limits and providing operator input indicative of the position of the machine at such swing limits. This was tedious. Instead, using embodiments of the present invention, the new position can be calculated using IMU information, as indicated at block 464, and visual odometry information is indicated at block 466. Additionally, by using a priori information relative to the e-fence (e.g. it corresponds to a highway barrier, or straight line), the position of new e-fence information can be calculated based upon the a priori e-fence information and the new position of the excavator. Thus, at block 468, the controller of the excavator, such as controller 202, automatically updates e-fence information based on the new position and the a priori information of the e-fence.

Next, at block 470, method 450 automatically identifies features in images in the output of the backup camera at the new position. As indicated, feature identification can be done in a variety of ways, such as using a neural network 472, explicit user definitions 474, or other techniques 476. Accordingly, as the excavator moves, the e-fence may be automatically updated, and visual odometry may automatically identify new features at the new position to continue to provide enhanced positional information for excavator control. Thus, not only do embodiments of the present invention remove some of the tedious operations currently required of excavator operators in order to ensure safety, they also provide improved position determination and control.

In this way, embodiments of the present invention generally leverage an excavator backup camera as a vision system that automatically finds markers in the environment that inform the machine and operator of movement of the excavator and automatically propagate control boundaries (e.g., e-fence) forward relative to the barrier. This significant improvement to excavator operation and control is provided without adding significant expense to the excavator.

As described above, when a priori information relative to a barrier or e-fence is known, it can automatically be updated as the excavator position is changed. In accordance with an embodiment described herein, some of the a priori information relative to the e-fence or barrier may be obtained automatically using the backup camera and vision processing system. For example, the vision processing system may be configured to identify a concrete temporary barrier of the type used during road construction and/or traffic cones. Further, the vision processing system may be used in combination with specifically-configured e-fence markers that are physically placed in the real world to identify an e-fence. When the vision processing system identifies such markers in its field of view, it can automatically establish the a priori information. Accordingly, such vision markers could be set in a way that defines a curve and the a priori information would include extrapolation of the curve between and beyond the markers. In another example, the operator may simply rotate the house such that the backup camera views a particular barrier or at least has a field of view covering where an e-fence is desired, and may provide an operator input, such as drawing a line or curve on a touch screen displaying the backup camera image that automatically sets the a priori information.

Figure 7:
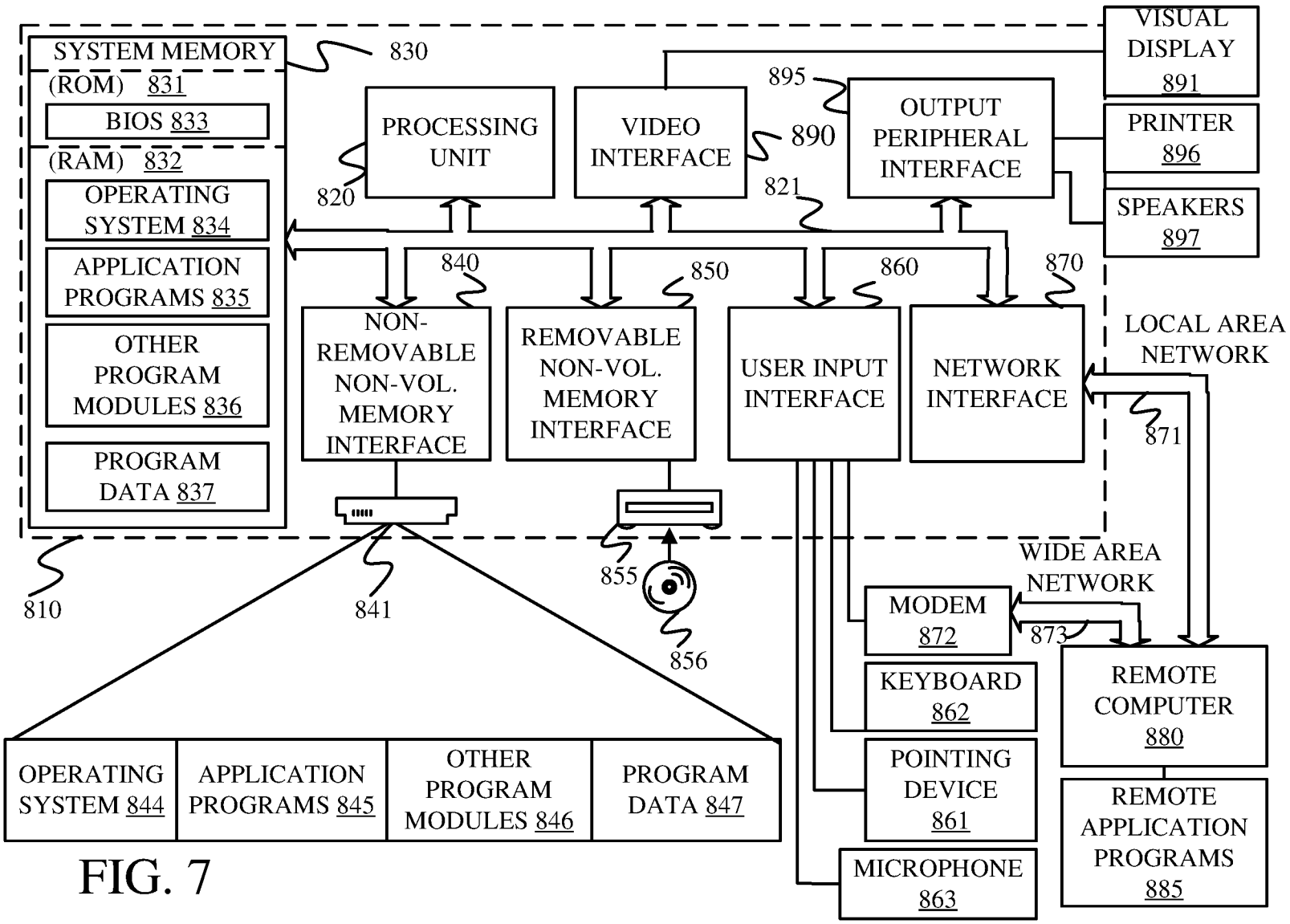
FIG. 7 is a diagrammatic view showing an example computing environment for processing sensing inputs.

FIG. 7 is one embodiment of a computing environment in which elements of FIG. 3, or parts of it, (for example) can be deployed. With reference to FIG. 7, an exemplary system for implementing some embodiments includes a general-purpose computing device in the form of a computer 810. Components of computer 810 may include, but are not limited to, a processing unit 820 (which can comprise controller 202), a system memory 830, and a system bus 821 that couples various system components including the system memory to the processing unit 820. The system bus 821 may be any of several types of bus structures including a memory bus or memory controller, a peripheral bus, and a local bus using any of a variety of bus architectures. Memory and programs described with respect to FIG. 3 can be deployed in corresponding portions of FIG. 7.

Computer 810 typically includes a variety of computer readable media. Computer readable media can be any available media that can be accessed by computer 810 and includes both volatile and nonvolatile media, removable and non-removable media. By way of example, and not limitation, computer readable media may comprise computer storage media and communication media. Computer storage media is different from, and does not include, a modulated data signal or carrier wave. It includes hardware storage media including both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 810. Communication media may embody computer readable instructions, data structures, program modules or other data in a transport mechanism and includes any information delivery media. The term "modulated data signal" means a signal that has one or more of its characteristics set or changed in such a manner as to encode information in the signal.

Figure 10:
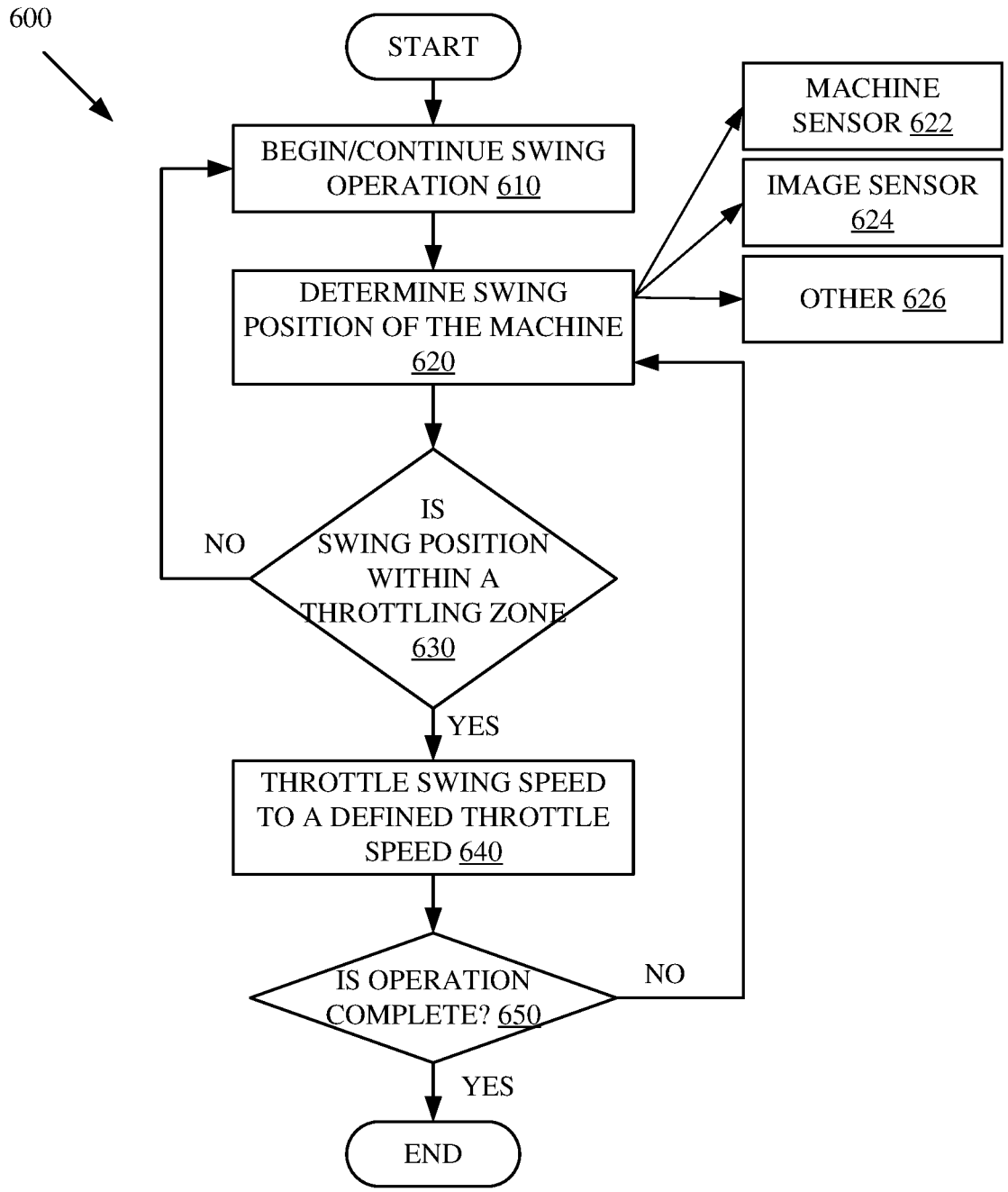
FIG. 10 is a flow diagram showing an example machine operation.

The system memory 830 includes computer storage media in the form of volatile and/or nonvolatile memory such as read only memory (ROM) 831 and random-access memory (RAM) 832. A basic input/output system 833 (BIOS), containing the basic routines that help to transfer information between elements within computer 810, such as during start-up, is typically stored in ROM 831. RAM 832 typically contains data and/or program modules that are immediately accessible to and/or presently being operated on by processing unit 820. By way of example, and not limitation, FIG. 10 illustrates operating system 834, application programs 835, other program modules 836, and program data 837.

The computer 810 may also include other removable/non-removable volatile/nonvolatile computer storage media. By way of example only, FIG. 10 illustrates a hard disk drive 841 that reads from or writes to non-removable, nonvolatile magnetic media, a magnetic disk drive 851, nonvolatile magnetic disk 852, an optical disk drive 855, and nonvolatile optical disk 856. The hard disk drive 841 is typically connected to the system bus 821 through a non-removable memory interface such as interface 840, and magnetic disk drive 851 and optical disk drive 855 are typically connected to the system bus 821 by a removable memory interface, such as interface 850.

Alternatively, or in addition, the functionality described herein can be performed, at least in part, by one or more hardware logic components. For example, and without limitation, illustrative types of hardware logic components that can be used include Field-programmable Gate Arrays (FPGAs), Program-specific Integrated Circuits (e.g., ASICs), Program-specific Standard Products (e.g., ASSPs), System-on-a-chip systems (SOCs), Complex Programmable Logic Devices (CPLDs), etc.

The drives and their associated computer storage media discussed above and illustrated in FIG. 7, provide storage of computer readable instructions, data structures, program modules and other data for the computer 810. In FIG. 7, for example, hard disk drive 841 is illustrated as storing operating system 844, application programs 845, other program modules 846, and program data 847. Note that these components can either be the same as or different from operating system 834, application programs 835, other program modules 836, and program data 837.

A user may enter commands and information into the computer 810 through input devices such as a keyboard 862, a microphone 863, and a pointing device 861, such as a mouse, trackball or touch pad. Other input devices (not shown) may include a joystick, game pad, satellite dish, scanner, or the like. These and other input devices are often connected to the processing unit 820 through a user input interface 860 that is coupled to the system bus, but may be connected by other interface and bus structures. A visual display 891 or other type of display device is also connected to the system bus 821 via an interface, such as a video interface 890. In addition to the monitor, computers may also include other peripheral output devices such as speakers 897 and printer 896, which may be connected through an output peripheral interface 895.

The computer 810 is operated in a networked environment using logical connections (such as a local area network—LAN, or wide area network WAN) to one or more remote computers, such as a remote computer 880.

When used in a LAN networking environment, the computer 810 is connected to the LAN 871 through a network interface or adapter 870. When used in a WAN networking environment, the computer 810 typically includes a modem 872 or other means for establishing communications over the WAN 873, such as the Internet. In a networked environment, program modules may be stored in a remote memory storage device. FIG. 10 illustrates, for example, that remote application programs 885 can reside on remote computer 880.

Figure 8:
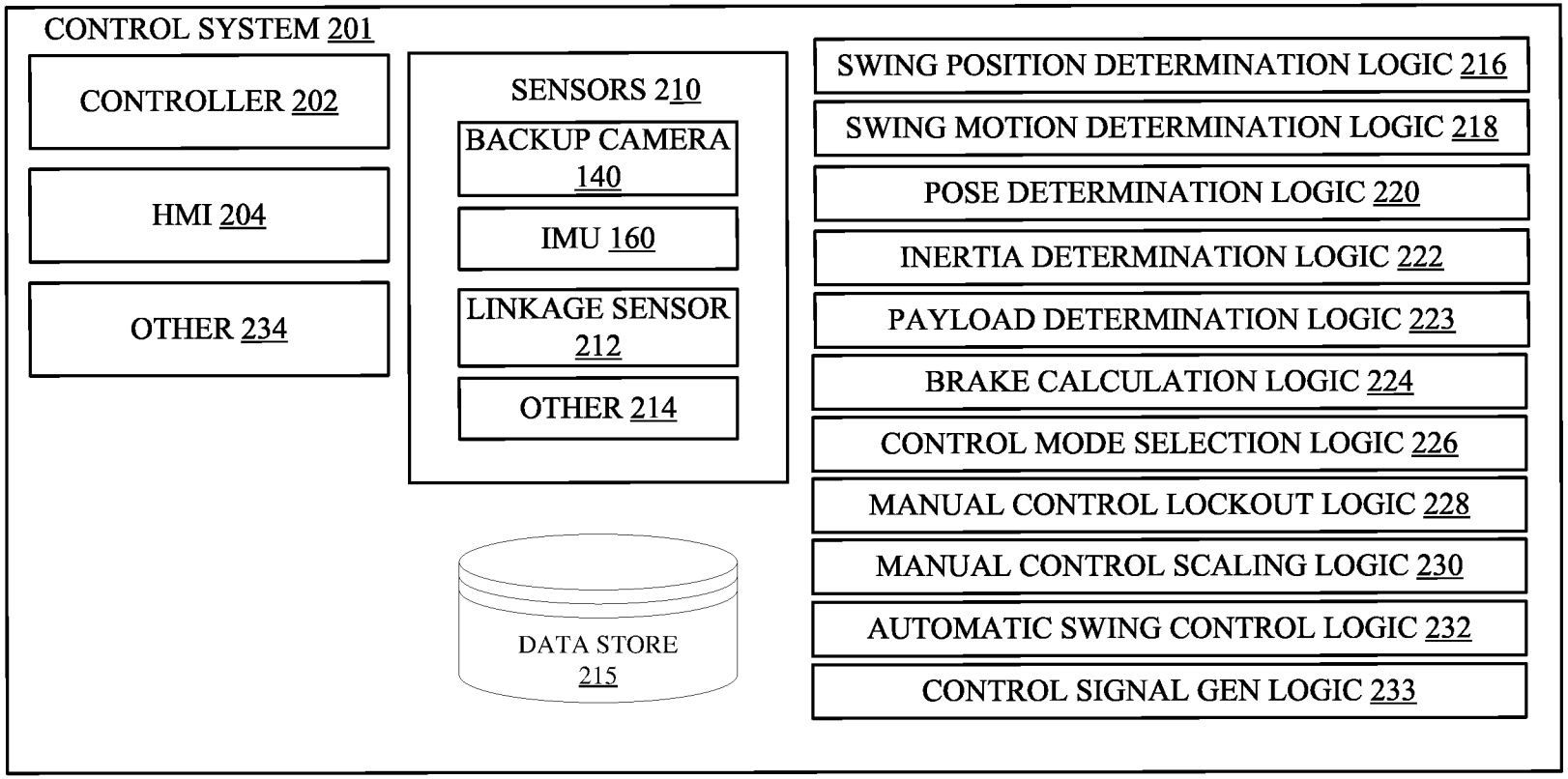
FIG. 8 is a block diagram showing an example control system.

FIG. 8 is a block diagram showing an example control system 201. As shown, control system 201 includes controller 202, HMI 204, sensors 210, a data store 215 and a variety of logic components 216-232 can include other items as well, as indicated by block 234. Some of these components have been described above with respect to FIG. 3. The sensors 210 include camera 140, IMU 160, linkage sensor(s) 212 and can include other sensors as well as indicated by block 214. For example, sensors that measure the torque applied at the swing motor (e.g., pressure cells on the work ports). The following figures are described with regard to machine swing, however, these techniques may also be applicable with vertical or non-rotational lateral (extension) e-fences or zones. Data store 215 stores a variety of different data. For example, data store 215 contains weight and dimensional data for the given machine 100, (e.g., the mass, size dimensions, etc. of the boom, stick, bucket and house). Like all the shown components, data store 215 may be located on machine 100 or locate remote from machine 100.

Swing position determination logic 216 determines the current swing position of the house and accordingly, the linkage set. Swing position determination logic 216 can calculate the swing position in a variety of different ways. For example, a sensor output is converted into a swing position (e.g., a gyroscope, a compass, a potentiometer, etc.). In another example, swing position determination logic 216 calculates the swing position based on backup camera 140, as previously discussed with respect to FIG. 4. Of course, swing position determination logic 216 can calculate the swing position in other ways as well.

Swing motion determination logic 218 determines the swing or rotational motion of the house 104 and accordingly, the linkage set. For example, swing motion determination logic 218 determines the swing motion by deriving it from the output from swing position determination logic 216 over time. In another example, swing motion determination logic 218 receives sensor signals and converts the sensor output into a swing motion value. For instance, swing motion determination logic 218 can complete image analysis on frames of a video captured via a camera proximate machine 100 (e.g., located on or pointed at the machine) and determine the swing motion. Swing motion determination logic 218 can, of course, calculate the swing motion in other ways as well.

Pose determination logic 220 determines the pose of machine 100, that is, the arrangement of the different linkages of machine 100. For instance, the pose of machine 100 includes relative positions of boom 110, stick 116 and bucket 124 relative to one another and/or to cab 104 or some other point.

Inertia determination logic 222 can receive pose data from pose determination logic 220 machine dimensions and mass data from data store 215, the swing motion data from swing motion determination logic 218 and determine the inertia of the system based on the received data. The pose of the machine is relevant, for example, because as the arm and boom are extended, the center of mass of machine 100 will shift farther away from the swing pivot point and the moment of inertia of machine 100 will increase.

Payload determination logic 223 determines the mass of material in bucket 124. The mass within bucket 124 may be used by inertia determination logic 222 to calculate the inertia of the overall system. The mass can also be used in other calculations by other logic components. Payload determination logic 223 can determine the mass in a number of different ways. For example, payload determination logic 223 can estimate or determine the mass of material in bucket 124 based on a change in swing speed and the calculated inertia about the swing axis due to known machine components. In another example, payload determination logic 223 determines the material in bucket 124 by analyzing video or images of bucket 124. Of course, payload determination logic 223 can calculate the payload in other ways as well.

Brake calculation logic 224 receives an inertia value from inertia determination logic 222 to calculate a time and rotational displacement it will take to reduce the current swing speed to a given speed or to a stop. Brake calculation logic 224 uses the inertia value (e.g., from inertia determination logic 222) and a known braking ability of machine 100 to calculate the time or displacement to reduce the speed of machine 100 to the target speed.

Control mode selection logic 226 allows a user to generate an interface or otherwise allows a user to select a control mode for control system 201. For example, control modes may include manual control lockout mode, manual control scaling mode and automatic swing control mode.

Manual control lockout logic 228 implements the manual control lockout mode control mode. In this mode, manual control is blocked, ignored or otherwise locked out when the user reaches a predefined zone (e.g., an e-fence) such that a user cannot control the swing in of machine 100 in one or more directions. One example implementation of this control mode can be utilized, for example, when machine 100 is proximate a busy road, such that, without limitation the linkages of machine 100 could be swung into the busy road. In this example, the predefined zone would correspond to the location of the road, therefore the user could control the swing of machine 100 to the edge of the road but be prevented from swinging machine 100 into vehicles that may be on the road.

Manual control throttling mode is implemented by manual control throttling logic 230. In this mode, manual control is limited to a given speed when the machine enters a predefined zone. For instance, there may be a predefined zone where the swing motion is limited to 10% of its maximum speed. One example implementation of this control mode can be utilized, for example, when machine 100 is digging a trench along a building foundation such that the linkages of machine 100 could be swung into the building. To reduce the risk of an operator colliding the building at a damaging speed, manual control throttling logic 230 could set a maximum speed within a given distance of the wall, but not necessarily prevent manually movement of machine 100. With a reduced maximum speed, the operator can more precisely control the linkages of machine 100 to get a close dig along the building foundation without damaging the building.

Automatic swing control mode is implemented by automatic swing control logic 232. In this mode, machine 100 is automatically swung to a predefined swing position. One example implementation of this control mode can be utilized, for example, when machine 100 is digging a trench. The operator can set the location of the trench and after dumping a load from bucket 124 machine 100 can automatically swing back to the trench location.

Control signal generator logic 233 generates a control signal (e.g., control outputs 206) to control components of machine 100.

Figure 9:
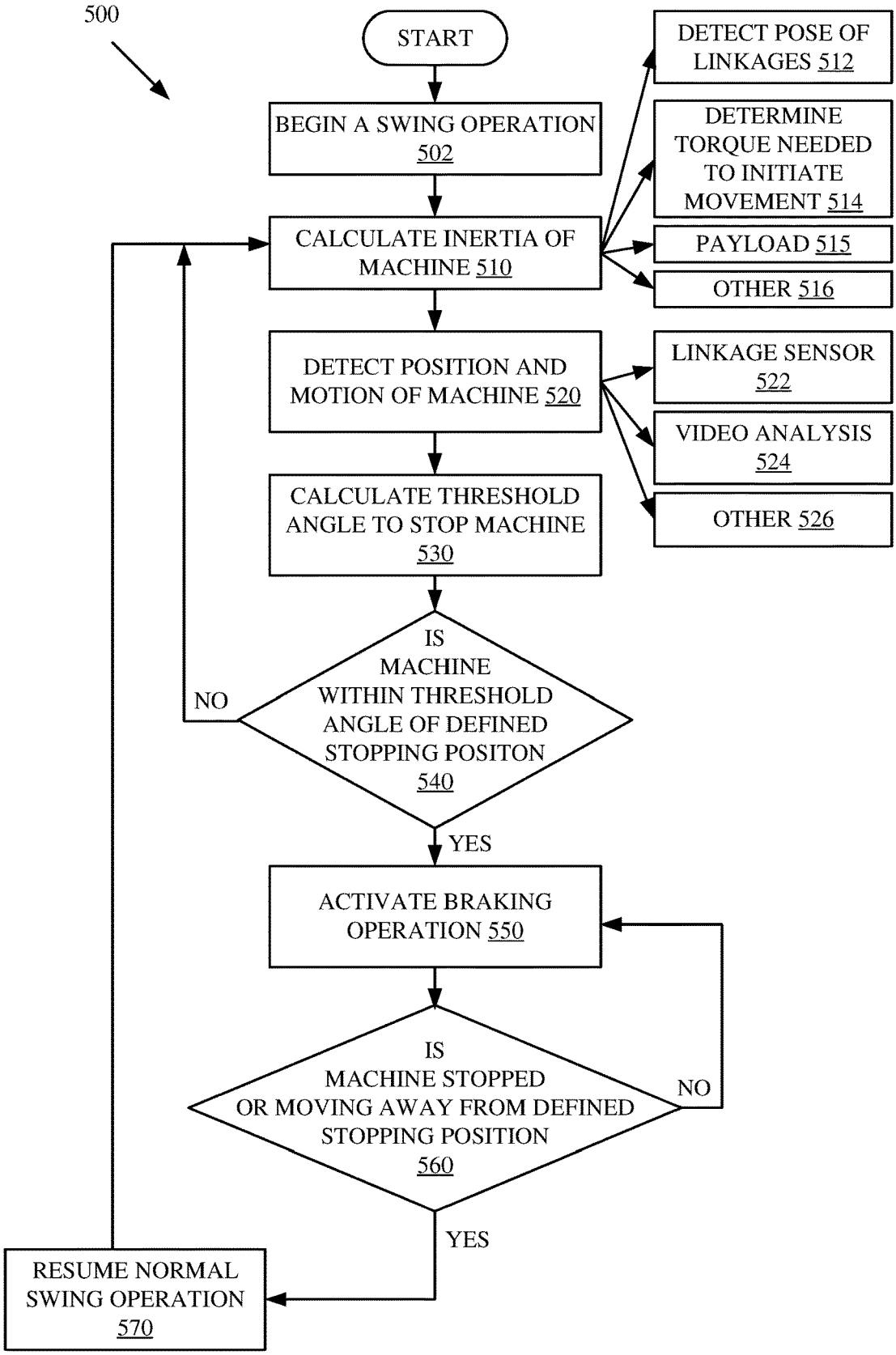
FIG. 9 is a flow diagram showing an example machine operation.

FIG. 9 is a flow diagram showing an example swing operation 500. Operation 500 begins at block 502. For example, the operator starts machine 100 and begins a job at a worksite.

At block 510 the inertia of the linkage set/machine 100 is calculated by inertia determination logic 222. As indicated by block 512, the pose of linkages can be utilized to determine the inertia based on the pose of linkages determined by pose determination logic 220. As noted above, the pose is relevant to the inertia calculation because the poses of linkages directly change the moment of inertia for the system. As shown by block 514, the torque to initiate the swing movement is used by inertia determination logic 222 to calculate the inertia of the system. Because the torque used to accelerate machine 100 is substantially the same as the torque that will be required to stop decelerate machine 100, this method may not have to use the pose of the system to calculate the inertia. As indicated by block 515, the payload mass and/or location can be used to calculate the inertia of machine 100. Of course, the inertia can be determined in other ways as well as by block 516.

Operation 500 proceeds at block 520 where the position and/or motion of machine 100 are detected or determined. As indicated by block 522, the position and/or motion of machine 100 and can be sensed by a linkage sensor (e.g., gyroscope, compass, IMU, potentiometer, etc.). As indicated by block 524, the swing position and/or motion of machine 100 can be determined via image analysis (e.g., video from backup camera 140 or some other camera mounted proximate machine 100). Of course, the swing position and/or motion of machine 100 can be determined in other ways as well as indicated by block 526.

Operation 500 proceeds at block 530 where brake calculation logic 224 calculates the angular and/or temporal displacement to stop the swing motion of machine 100. The angular and/or temporal displacement required to stop typically relates to one or more of: the current swing speed, the current machine inertia, and the torque that the brake system can apply. For instance, using kinematic algorithms the angular and/or temporal displacement to reduce speed can be calculated. E.g., one algorithm to calculate the angle it takes to stop the swing motion is ½*inertia*(swing speed)^2/(maximum swing motor torque).

Operation 500 proceeds at block 540 where it is determined if the machine is within the threshold angle of the defined stopping position. For example, the threshold angle is the angular displacement, or braking displacement, required for machine 100 to stop. If so then operation 500 proceeds at block 550. If not, then operation 500 proceeds again at block 510.

At block 540, a braking operation is activated or initiated. That is, the machine begins to apply a brake or otherwise decelerates. For instance, if the swing speed is low, simply reducing throttle may allow friction to stop the machine swing. However, if the swing speed is high then mechanical, hydraulic or other types of braking may be necessary.

At block 560, it is determined if the machine has stopped or is moving away from the predefined stopping or limit position. If so then operation 500 proceeds at block 570 where normal operations are resumed. If not, then the braking operation of block 550 is continued.

FIG. 10 is a flow diagram showing an example swing operation 600 with swing throttling. As shown, operation 600 begins at block 610 where the swing operation begins (e.g., machine 100 begins swinging in a direction).

Operation 600 proceeds at block 620 where the swing position of machine 100 is determined by swing position determination logic 216. The swing position of machine 100 can be determined in a number of different ways as indicated by blocks 622-626. As indicated by block 622, a machine sensor can generate a sensor output which swing position determination logic 216 translates into a swing position. As indicated by block 624, an image sensor (located on or proximate machine 100) can capture an image that swing position determination logic 216 uses to calculate the swing position. Of course, the swing position can be determined in other ways as well, as indicated by block 626.

Operation 600 proceeds at block 630 where it is determined if the swing position is in a throttling zone. For example, the current location determined in block 620 is compared against throttling zone locations.

Operation 600 proceeds at block 640 where the swing speed is throttled to the predetermined speed. In some examples, there may be a threshold zone in between an unrestricted speed zone and a throttling zone where the swing is decelerated to the throttling speed. In this instance, operation 500 of FIG. 9 may be utilized to ensure that machine 100 is decelerated to the throttled speed before it enters the throttling zone.

Operation 600 proceeds at block 650 where it is determined if the swing operation is complete. If so then operation 600 ends. If not, then operation 600 proceeds to block 620.

Figure 11:
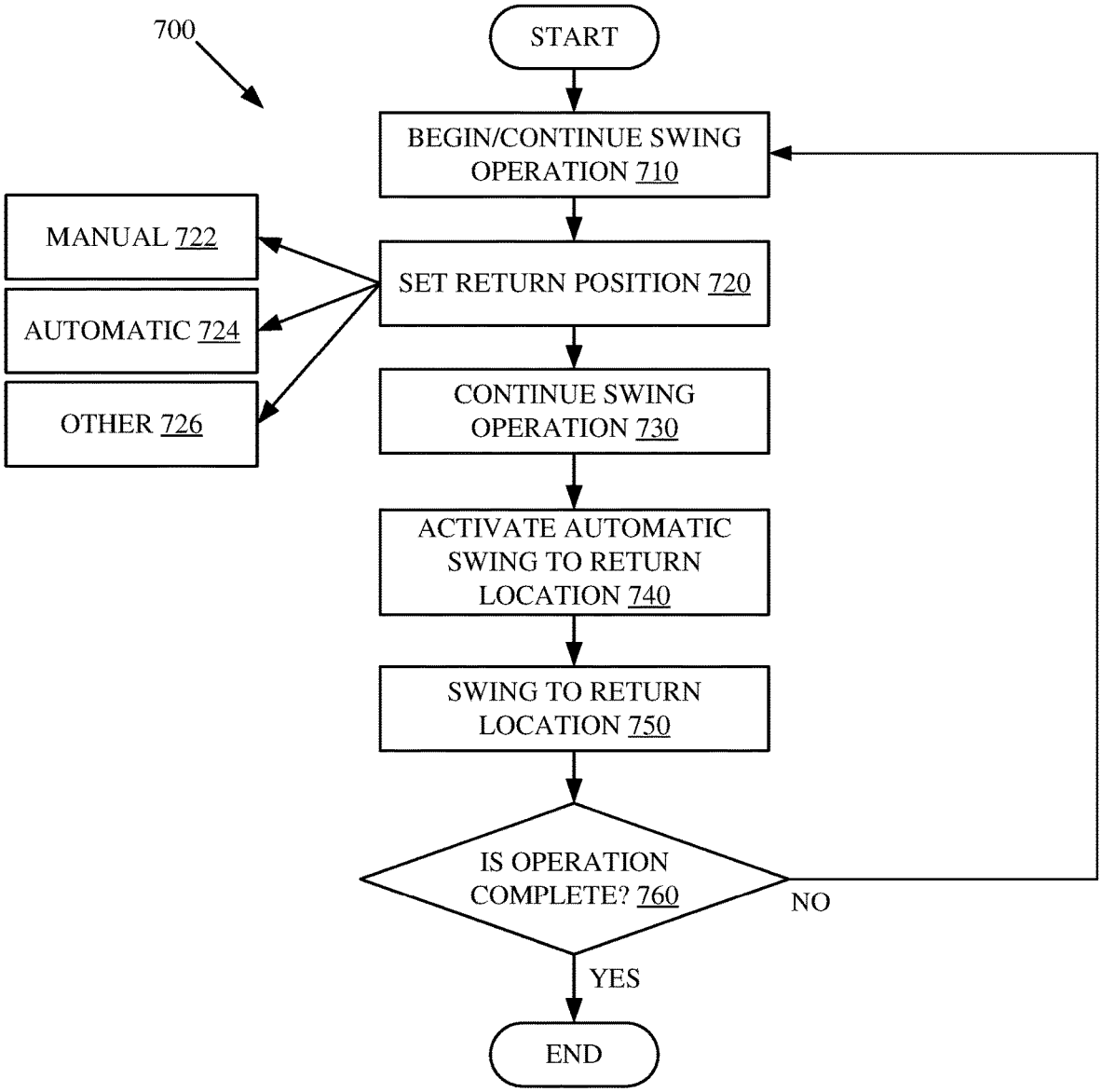
FIG. 11 is a flow diagram showing an example machine operation.

FIG. 11 is a flow diagram showing an example swing operation 700 with a return to position feature. In some cases, an operator is digging a trench or completing a different type of job that requires them to continually swing machine 100 from a first position to other positions. Operation 700 begins at block 710 where the swing operation begins (e.g., machine 100 begins swinging in a direction).

Operation 700 proceeds at block 720 where the return position is set. As indicated by block 722, the return position can be set manually by the operator. For instance, the operator may swing machine 100 to the desired return position and actuate a button or other interface device to set the return location. As indicated by block 724, the return position can be set automatically. For example, automatic swing control logic 232 monitors the swing position of machine 100 over time and determines where the operator repeatedly stops machine 100.

Operation 700 proceeds at block 730, where the swing operation continues. For example, the operator continues the job they are working on, by swinging the load from the first position to another position. Automatically swinging machine 100 to the return location can include some of the steps in operation 500 of FIG. 9. For example, the inertia and braking can be calculated so that machine 100 stops at the correct location.

Operation 700 then proceeds at block 740, where the automatic swing to return location is activated. As indicated by block 742, this can be activated by the operator manually. As indicated by block 744, the swing can be activated in other ways as well.

Operation 700 proceeds at block 750, where machine 100 automatically swings to the return position. Operation 500 of FIG. 4 may be utilized to ensure that machine 100 is decelerated appropriately to not over shoot the return position.

Operation 700 proceeds at block 760 where it is determined if the swing operation is complete or not. If so then operation 700 ends. If not, then operation 700 proceeds to block 710.

It should also be noted that the different embodiments described herein can be combined in different ways. That is, parts of one or more embodiments can be combined with parts of one or more other embodiments. All of this is contemplated herein. The flow diagrams are shown in a given order it is contemplated that the steps may be done in a different order than shown.

Example 1 is an excavator comprising:

a rotatable house;

a bucket operably coupled to the rotatable house;

one or more swing sensors operably coupled to the excavator and configured to provide at least one rotation sensor signal indicative of rotation of the rotatable house; and one or more controllers coupled to the sensor, the one or more controllers being configured to implement:

inertia determination logic that determines the inertia of a portion of the excavator; and control signal generator logic that generates a control signal to control the excavator, based on the inertia of the portion of the excavator.

Example 2 is the excavator of any or all previous examples, wherein the one or more controllers are configured to implement:

pose determination logic that determines the pose of the portion of the excavator and generates a pose signal; and wherein the inertia determination logic determines the inertia of the portion of the excavator based on the pose signal.

Example 3 is the excavator of any or all previous examples, further comprising linkage sensors coupled to the excavator and configured to provide pose sensor signals indicative of the pose of the excavator; and wherein the pose determination logic determines the pose of the portion of the excavator based on the pose sensor signals.

Example 4 is the excavator of any or all previous examples, wherein the inertia determination logic retrieves machine weight and dimension data from a datastore and wherein the inertia determination logic calculates the inertia based on the machine weight and dimension data.

Example 5 is the excavator of any or all previous examples, wherein the one or more controllers are configured to implement:

swing position logic that determines a swing position of the excavator based on the rotation sensor signal and generates a swing position signal; and wherein the excavator is controlled based on the swing position sensor.

Example 6 is the excavator of any or all previous examples, wherein the one or more controllers are configured to implement:

swing motion logic that determines a swing speed of the excavator based on the rotation sensor signal and generates a swing speed signal; and wherein the excavator is controlled based on the swing speed signal.

Example 7 is the excavator of any or all previous examples, wherein the one or more controllers are configured to implement:

manual control lockout logic that controls the excavator to brake before reaching a limit position.

Example 8 is the excavator of any or all previous examples, wherein the one or more controllers are configured to implement:

manual control throttling logic that controls the excavator to throttle below a threshold speed when the excavator swings between two limit positions.

Example 9 is the excavator of any or all previous examples, wherein the one or more controllers are configured to implement:

automatic swing control logic that controls the excavator to swing to a predefined position.

Example 10 is the excavator of any or all previous examples, wherein the swing sensor comprises an IMU.

Example 11 is the excavator of any or all previous examples, wherein the swing sensor comprises a backup camera.

Example 12 is a method of controlling an excavator, the method comprising:

obtaining a sensor signal from a swing senor operably coupled to the excavator;

obtaining a limit position;

determining a swing position of the excavator based on the sensor signal;

comparing the swing position with the limit position and generating a comparison output indicative of the comparison; and controlling the excavator based on the comparison.

Example 13 is the method of any or all previous examples, further comprising:

obtaining a brake torque;

determining a swing speed of the excavator based on the sensor signal;

calculating a braking displacement based on the brake torque and the swing speed; and controlling the excavator based at least in part on the braking displacement.

Example 14 is the method of any or all previous examples, wherein calculating the braking displacement comprises:

determining an inertia of the excavator based on the swing speed of the excavator; and wherein calculating the braking displacement is based, at least in part, on the inertia of the excavator.

Example 15 is the method of any or all previous examples, wherein controlling the excavator comprises:

initiating a braking operation, based on the braking displacement, such that the excavator stops before reaching the limit position.

Example 16 is the method of any or all previous examples, wherein controlling the excavator comprises:

initiating a braking operation, based on the braking displacement, such that the excavator reduces to a threshold speed before reaching the limit position; and initiating a throttling operation, based on the comparison between the swing position with the limit position, such that an excavator swing speed does not exceed the threshold speed once swung past the limit position.

Example 17 is the method of any or all previous examples, wherein controlling the excavator comprises:

initiating a return operation, based on the braking displacement, such that the excavator travels to and stops at the limit position.

Example 18 is a control system for an excavator, the control system comprising:

a swing sensor that senses a characteristic of an excavator swing position and generates a swing sensor signal indicative of the characteristic;

swing position determination logic that receives the swing sensor signal and determines a swing position;

swing motion determination logic that receives the swing sensor signal and determines a swing motion of the excavator and generates a swing motion signal;

pose sensors that sense poses of components of the excavator and generates a pose sensor signal indicative of the poses of the components of the excavator;

pose determination logic that receives the pose sensor signal and generates a pose signal;

inertia determination logic that receives the swing motion signal and the pose signal and determines a swing inertia of the excavator;

brake calculation logic that receives the swing inertia signal and determines a braking displacement that the excavator will travel through before braking to a threshold speed;

manual control logic that controls the machine based on a comparison of a current swing position, the braking displacement and a limit position.

Example 19 is the method of any or all previous examples, wherein the manual control logic controls the excavator by decelerating the excavator to the threshold speed before it reaches the limit position.

Example 20 is the method of any or all previous examples, wherein the threshold speed is zero.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An excavator comprising:

a rotatable house;

a bucket operably coupled to the rotatable house;

one or more swing sensors operably coupled to the excavator and configured to provide at least one rotation sensor signal indicative of rotation of the rotatable house; and one or more controllers coupled to the sensor, the one or more controllers being configured to implement:

inertia determination logic that determines the inertia of a portion of the excavator;

control signal generator logic that generates a control signal to control the excavator, based on the inertia of the portion of the excavator;

wherein the inertia determination logic retrieves machine weight and dimension data from a datastore and wherein the inertia determination logic calculates the inertia based on the machine weight and dimension data; and manual control lockout logic that controls the excavator to brake before reaching a limit position.

2. The excavator of claim 1, wherein the one or more controllers are configured to implement:

pose determination logic that determines the pose of the portion of the excavator and generates a pose signal; and wherein the inertia determination logic determines the inertia of the portion of the excavator based on the pose signal.

3. The excavator of claim 2, further comprising linkage sensors coupled to the excavator and configured to provide pose sensor signals indicative of the pose of the excavator; and wherein the pose determination logic determines the pose of the portion of the excavator based on the pose sensor signals.

4. The excavator of claim 1, wherein the one or more controllers are configured to implement:

swing position logic that determines a swing position of the excavator based on the rotation sensor signal and generates a swing position signal; and wherein the excavator is controlled based on the swing position sensor.

5. The excavator of claim 1, wherein the one or more controllers are configured to implement:

swing motion logic that determines a swing speed of the excavator based on the rotation sensor signal and generates a swing speed signal; and wherein the excavator is controlled based on the swing speed signal.

6. The excavator of claim 5, wherein the one or more controllers are configured to implement:

automatic swing control logic that controls the excavator to swing to a predefined position.

7. The excavator of claim 1, wherein the swing sensor comprises an IMU.

8. The excavator of claim 7, wherein the swing sensor comprises a backup camera.

9. An excavator comprising:

a rotatable house;

a bucket operably coupled to the rotatable house;

one or more swing sensors operably coupled to the excavator and configured to provide at least one rotation sensor signal indicative of rotation of the rotatable house; and one or more controllers coupled to the sensor, the one or more controllers being configured to implement:

inertia determination logic that determines the inertia of a portion of the excavator;

control signal generator logic that generates a control signal to control the excavator, based on the inertia of the portion of the excavator;

wherein the inertia determination logic retrieves machine weight and dimension data from a datastore and wherein the inertia determination logic calculates the inertia based on the machine weight and dimension data; and manual control throttling logic that controls the excavator to throttle below a threshold speed when the excavator swings between two limit positions.

10. The excavator of claim 9, wherein the one or more controllers are configured to implement:

pose determination logic that determines the pose of the portion of the excavator and generates a pose signal; and wherein the inertia determination logic determines the inertia of the portion of the excavator based on the pose signal.

11. The excavator of claim 2, further comprising linkage sensors coupled to the excavator and configured to provide pose sensor signals indicative of the pose of the excavator; and wherein the pose determination logic determines the pose of the portion of the excavator based on the pose sensor signals.

12. The excavator of claim 9, wherein the one or more controllers are configured to implement:

swing position logic that determines a swing position of the excavator based on the rotation sensor signal and generates a swing position signal; and wherein the excavator is controlled based on the swing position sensor.

13. The excavator of claim 9, wherein the one or more controllers are configured to implement:

swing motion logic that determines a swing speed of the excavator based on the rotation sensor signal and generates a swing speed signal; and wherein the excavator is controlled based on the swing speed signal.

* * * * *